United States Patent [19]

Chadshay et al.

[11] 4,304,196

[45] Dec. 8, 1981

[54] APPARATUS FOR TILTING LOW LOAD COAL NOZZLE

[75] Inventors: Roman Chadshay, Windsor; Richard L. Belanger, Tolland, both of Conn.

[73] Assignee: Combustion Engineering, Inc., Windsor, Conn.

[21] Appl. No.: 85,563

[22] Filed: Oct. 17, 1979

[51] Int. Cl.[3] ..... F22B 37/42; F23D 1/00

[52] U.S. Cl. ..... 122/449; 110/347; 110/261; 110/263; 122/479 B

[58] Field of Search ..... 122/479 R, 479 B, 449; 110/261, 263, 347; 239/587; 431/176

[56] References Cited

U.S. PATENT DOCUMENTS

| | | | |
|---|---|---|---|
| 2,363,875 | 11/1944 | Kreisinger et al. | 110/263 |
| 2,575,885 | 11/1951 | Mittendorf | 122/479 B |
| 2,608,168 | 8/1952 | Jackson | 431/176 |
| 2,649,079 | 8/1953 | VanBrunt | 122/479 B |
| 2,663,287 | 12/1953 | Armacost | 122/479 B |
| 2,685,279 | 8/1954 | Caracristi | 122/479 B |
| 2,800,888 | 7/1957 | Miller et al. | 110/261 |
| 2,895,435 | 7/1959 | Bogot et al. | 239/424 |
| 3,221,714 | 12/1965 | Dickey | 122/479 R |

*Primary Examiner*—Henry C. Yuen

*Attorney, Agent, or Firm*—William W. Habelt

[57] ABSTRACT

In a pulverized coal-fired steam generator having a generally vertical furnace (1) and a plurality of fuel-air admission assemblies (10) arrayed in a vertical windbox (40) in one or more walls of the furnace (1), at least one of the fuel-air admission assemblies (10) being a low load fuel-air admission assembly having a split coal bucket (30) with vertically adjustable upper and lower coal nozzles (32,34), the remaining assemblies having vertically adjustable single nozzle buckets (28), a tilt apparatus (50,60) for vertically adjusting all nozzles in unison in response to steam temperature at high loads and for vertically adjusting the lower coal nozzles of the split coal bucket of the low load fuel-air admission assembly independent of all remaining nozzles at low loads.

2 Claims, 5 Drawing Figures

APPARATUS FOR TILTING LOW LOAD COAL NOZZLE

BACKGROUND OF THE INVENTION

The present invention relates to pulverized coal-fired furnaces and, more particularly, to an apparatus for automatically tilting a vertical array of fuel-air admission assemblies, at least one of which employs a split coal bucket for improved low load firing.

One method of firing coal in conventional coal-fired steam generator boilers is known as tangential firing. In this method, pulverized coal is introduced to the furnace in a primary air stream through burners, termed fuel-air admission assemblies, disposed in windboxes located in the corners of the furnace. Each windbox comprises a vertical array of alternate secondary air compartments and fuel-air admission assemblies. The fuel-air streams discharged from these burners are aimed tangentially to an imaginary circle in the middle of the furnace. This creates a fireball which serves as a continuous source of ignition for the incoming coal. More specifically, a flame is established at one corner which in turn supplies the required ignition energy to stabilize the flame emanating from a corner downstream of and laterally adjacent to it. However, at low loads the fireball deteriorates to four individual flames which frequently do not interact sufficiently to stabilize each other. Thus, at low loads it was frequently necessary to use auxiliary fuel such as light oil or natural gas to provide stabilization.

A distinct advantage of the tangential firing concept is that a wide range control of steam temperature can be obtained by tilting in unison the auxiliary air compartments and the fuel-air admission assemblies of the individual windbox upward or downward. By so doing, the fireball is physically raised or lowered within the furnace so as to increase or decrease the heat absorption by the furnace bounding waterwalls thereby effecting wide range control over the temperature of the combustion gases leaving the combustion zone and passing over downstream superheat and reheat surface. By tilting the fuel-air admission assemblies upward as load decreases, low load operation can be achieved while holding the overall cycle efficiency and maintaining better operation of the turbine. Additionally, the vertical adjustability of fuel-air admission assemblies permits the operator of the furnace to compensate for changes in heat absorption within a furnace waterwall resulting from fuel variations, in particular, for variations in the amount of slagging of the furnace waterwalls between different coals.

A recent improvement in a low load operation of coal-fired furnaces is disclosed in application for U.S. Letters Patents, Ser. No. 029,605, filed Apr. 13, 1979, in the name of Michael Scott McCartney for "Low Load Coal Bucket". The McCartney application discloses an improved fuel-air admission assembly incorporating a split coal bucket which permits a pulverized coal-fired furnace employing a tangential method to be operated at low loads without the use of auxiliary fuel to provide stabilization.

In accordance with the McCartney invention, the low load fuel-air admission assembly comprises a split coal bucket having independently tiltable upper and lower coal nozzles pivotally mounted to the coal delivery pipe. When the furnace is operating at low load such as during minimum demand periods, the primary air and pulverized coal streams discharging from the coal delivery pipe are split into an upper and lower coal-air stream and independently directed into the furnace by tilting the nozzles away from each other. In so doing, an ignition stabilizing pocket is established in a locally low pressure zone created between the spread apart coal-air streams. Hot combustion products are drawn, i.e., recirculated, into this low pressure zone thus providing enough additional ignition energy to the incoming fuel to stabilize the flame and eliminating the need for auxiliary stabilizing fuel such as oil or natural gas.

It is an object of the present invention to provide apparatus for vertically adjusting the fuel-air admission assemblies in order to maintain steam temperature while at the same time permitting the coal nozzles of the split coal bucket of the low load fuel-air admission assembly to be independently spread apart during low load operation.

SUMMARY OF THE INVENTION

In a pulverized coal-fired steam generator having a generally vertical furnace and a plurality of fuel-air admission assemblies arrayed in a vertical windbox in one or more walls of the furnace for introducing coal and air into the furnace, at least one of the fuel-air admission assemblies being a low load fuel-air admission assembly having a split coal bucket with vertically adjustable upper and lower coal nozzles, the remaining fuel-air admission assemblies having vertically adjustable single nozzle coal buckets, an apparatus for adjusting the vertical orientation of the upper and lower coal nozzles of the low load fuel-air admission and the single nozzle coal buckets of the remaining fuel-air admission assemblies.

In accordance with the invention, said apparatus comprises tilting means responsive to steam temperature variation for tilting the upper coal nozzle of the low load fuel-air admission assemblies upward in unison with the single nozzle coal bucket of the remaining fuel-air admission assemblies when the steam temperature drops below a preselected value and for tilting the upper coal nozzle of the low load fuel-air admission assemblies downward in unison with the single nozzle coal bucket of the remaining fuel-air admission assemblies when the steam temperature rises above a preselected value, and independent means responsive to steam temperature at higher load and independent of steam temperature at low loads for tilting the lower coal nozzle of the low load fuel-air admission assemblies in unison with the upper coal nozzle of the low load fuel-air admission assemblies in unison with the upper coal nozzle of the low load fuel-air admission assemblies at higher loads and for tilting the lower coal nozzle of the low load fuel-air admission assembly independent from and away from the upper coal nozzle of the low load fuel-air admission assemblies at low load so as to establish an angular separation between the respective coal-air streams exiting from the upper and lower coal nozzles of the low load fuel-air admission assemblies thereby providing a stable ignition pocket therebetween.

DESCRIPTION OF THE PREFERRED EMBODIMENT

In the tangential firing method, fuel and air are introduced into the furnace through fuel-air admission assemblies 10 mounted in corner windboxes 40 located in the four corners of the furnace 1. The fuel-air admission assemblies 10 are orientated so as to deliver the pulverized coal and air streams tangentially to an imaginary circle 3 in the center of the furnace 1 so as to form a rotating vortex-like flame termed the fireball therein.

Figure 2:
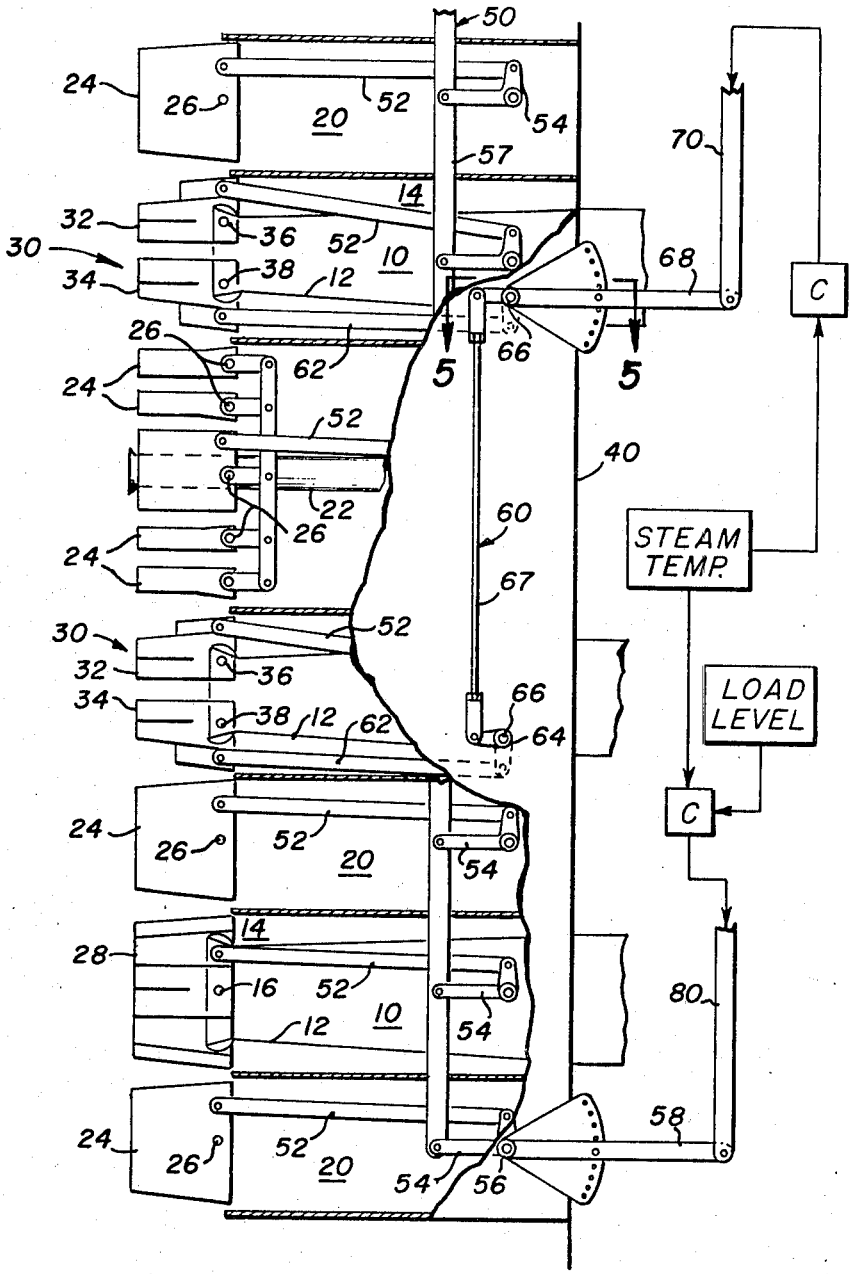
FIG. 2 is an elevational cross-sectional view, taken along line 2—2 of FIG. 1, of a windbox having a set of three fuel-air admission assemblies and of four auxiliary air compartments showing the tilt apparatus of the present invention.

As shown in FIG. 2, a plurality of fuel-air admission assemblies 10 are arranged in the corners in a vertical column within the windbox 40 separated by auxiliary air compartments 20. One or more of these auxiliary air compartments is adapted to accommodate an auxiliary fuel burner 22 which is used when starting and warming up the boiler and which may be used when necessary to provide additional ignition energy to stabilize the coal flame when operating at low loads.

Each fuel-air admission assembly 10 comprises coal delivery pipe 12 extending therethrough and opening into the furnace, and a secondary air conduit 14 which surrounds the coal delivery pipe 12 and provides a flow passage so that secondary air may be introduced in the furnace as a steam surrounding the primary air-pulverized coal stream discharged from coal delivery pipe 12. Each coal delivery pipe 12 is provided with a tip, termed a coal bucket, which is pivotally mounted to the coal delivery pipe 12 so that the coal bucket may be tilted about an axis transverse to the longitudinal axis of the coal delivery pipe 12. Similarly, each auxiliary air compartment 20 and secondary air conduit 14 is equipped with one or more tiltable air nozzles 24.

A typical single nozzle coal bucket 28 is shown in FIG. 2 mounted to the coal delivery pipe 12 of the lower fuel-air admission assembly. Coal bucket 12 can be tilted upward or downward about axis 16 in order to direct the pulverized coal-primary air mixture into the furnace in an upward or downward angle as a means of controlling the position of the fireball within the furnace thereby controlling steam temperature in the manner taught by the U.S. Pat. No. 2,363,857, issued Nov. 28, 1944, to Kreisinger et al for "Combustion Zone Control".

The upper two fuel-air admission assemblies shown in FIG. 2 have a split coal bucket 30 pivotally mounted to their respective coal delivery pipes. As disclosed in application for U.S. Letters Patent Ser. No. 029,605, filed Apr. 13, 1979, in the name of Michael Scott McCartney for "Low Load Coal Bucket". Each split coal bucket 30 comprises an upper coal nozzle 32 and a lower coal nozzle 34 both of which are independently tiltable about their respective axes 36 and 38 transverse to the longitudinal axis of the coal delivery pipe 12. By tilting the upper nozzle 32 upward, a first portion of the primary air and pulverized coal mixture discharging from coal delivery pipe 12 may be selectively directed upwardly into the furnace as an upper coal-air stream. Similarly, by tilting the lower coal nozzle downward, a second portion of the primary air and pulverized coal mixture discharging from the coal delivery pipe 12 can be selectively directed downwardly into the furnace as a lower coal air stream.

The apparatus 50,60 of the present invention provides for vertically adjusting the fuel-air admission assemblies in order to maintain steam temperature while at the same time permitting the lower coal nozzles 38 of the split buckets 30 of the low load fuel admission assemblies to be independently adjusted during low load operation. As indicated earlier, when the furnace equipped only with single nozzle coal buckets 28 was operated at low load, ignition became unstable and supplemental fuel such as natural gas or oil had to be fired in order to provide sufficient additional energy to stabilize the ignition of the single coal-air stream. By providing a split coal bucket having independently tiltable upper and lower coal nozzles, stable ignition at low loads can be achieved without firing supplemental fuel.

Figure 3:
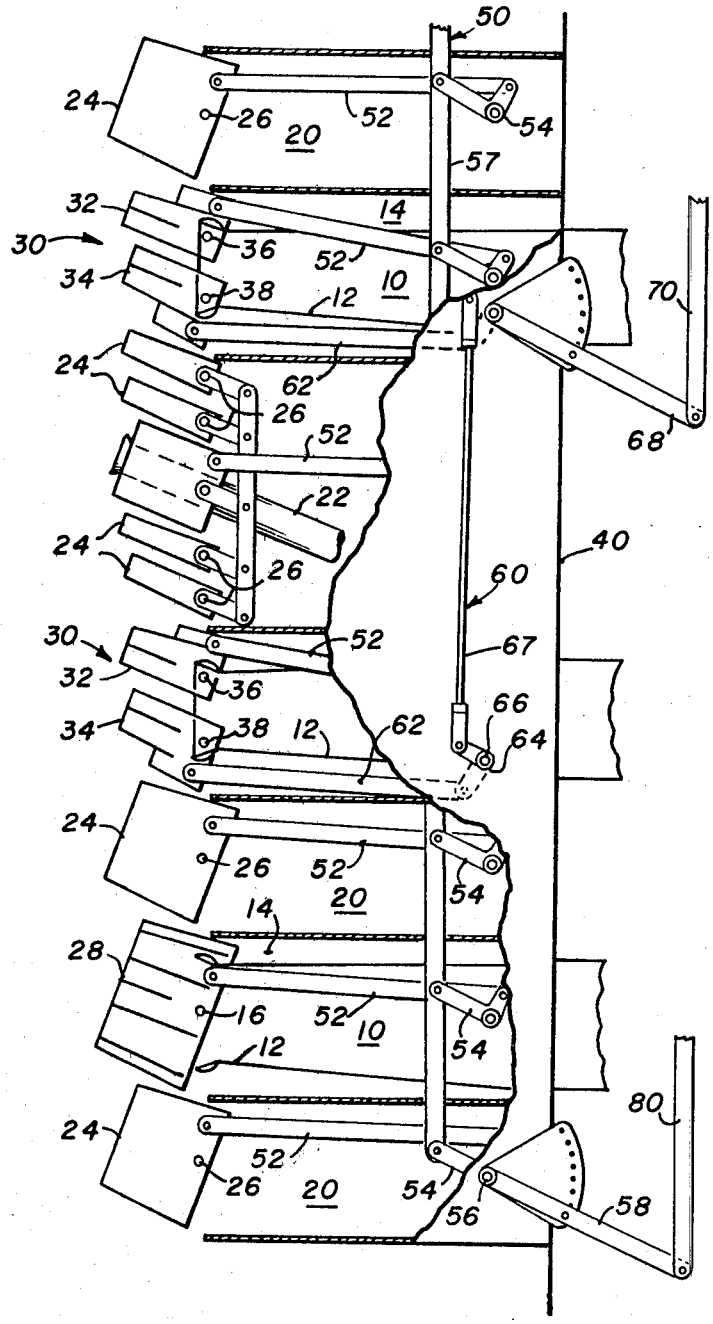
FIG. 3 is an elevational cross-sectional view of the windbox of FIG. 2 showing all nozzles tilted upward for steam temperature control as typifies operation at mid-load.

As mentioned previously, a distinct advantage of the tangential firing concept is that wide range control of steam temperatures may be obtained by tilting in unison the auxiliary air compartment nozzles 24 and fuel-air admission assembly coal bucket nozzles 28, 32 and 34 upward or downward. When the steam temperature departs from the preselected value, means 50 for adjusting the main tilt is activated. As load is reduced, steam temperature tends to drop. Accordingly, in response to this drop in steam temperature main tilt control lever 58, which is located externally of the windbox 40, is driven in a clockwise direction by main tilt adjustment means 80 about pivot point 56 thereby causing the lower belt crank 54, which is located internally within the windbox 40, to similarly rotate in a clockwise direction about pivot point 56 and the main tilt vertical extension arm 57, also located internally within the windbox 40, to translate upward as shown in FIG. 3. As extension arm 57 moves upward, each of the individual bulk cranks 54 rotates clockwise thereby causing their associated link rods 52 to translate rearward in the windbox. As links 52 translates rearward, air nozzles 24 and oil gun 22 tilt upward by rotating about their respective pivot points 26, the single nozzle coal bucket 28 tilts upward by rotating about pivot points 16, and the upper nozzle 32 of the split coal buckets 30 tilt upward by rotating about their respective pivot points 36.

In accordance with the present invention, a separate tilt apparatus 60 is provided for adjusting the vertical orientation of the lower nozzle 34 of the split coal buckets 30. When the furnace is operating at loads of approximately 30 percent of full load, means 70 for adjusting the low load tilt control lever 68 responds in unison with means 80 for adjusting the main tilt control lever 58. That is, both the low load tilt adjustment 70 and the main tilt adjustment 80 are tied into the furnace master control system and respond automatically to maintain steam temperature at a preselected value by tilting their associated nozzles upward or downward thereby raising or lowering the fireball within the furnace.

When operating the furnace at a load above approximately 30 percent of full load, the low load tilt adjustment 70 would respond to a drop in steam temperature by driving the low load tilt control lever 68, which is located externally of the windbox 40, in a clockwise direction about pivot point 56 thereby causing the low load tilt extension arm 60, which is also located externally of the windbox 40, to translate upward and also causing belt cranks 64 to rotate clockwise. As belt cranks 64 rotate clockwise, links 62 translate forward in the windbox 40 causing the lower nozzles 34 to tilt upward by rotating about pivot points 38 as illustrated in FIG. 3. When furnace rating drops below about 30 percent of full load, low load tilt adjustment 70 of the lower nozzle of the split coal bucket is divorced from steam temperature control. That is, a tilt of the lower nozzles of the split coal bucket no longer follows that of the remainder of the nozzles within the windbox. Rather, low load tilt apparatus 60 now operates completely independently of the main tilt apparatus 50.

Figure 4:
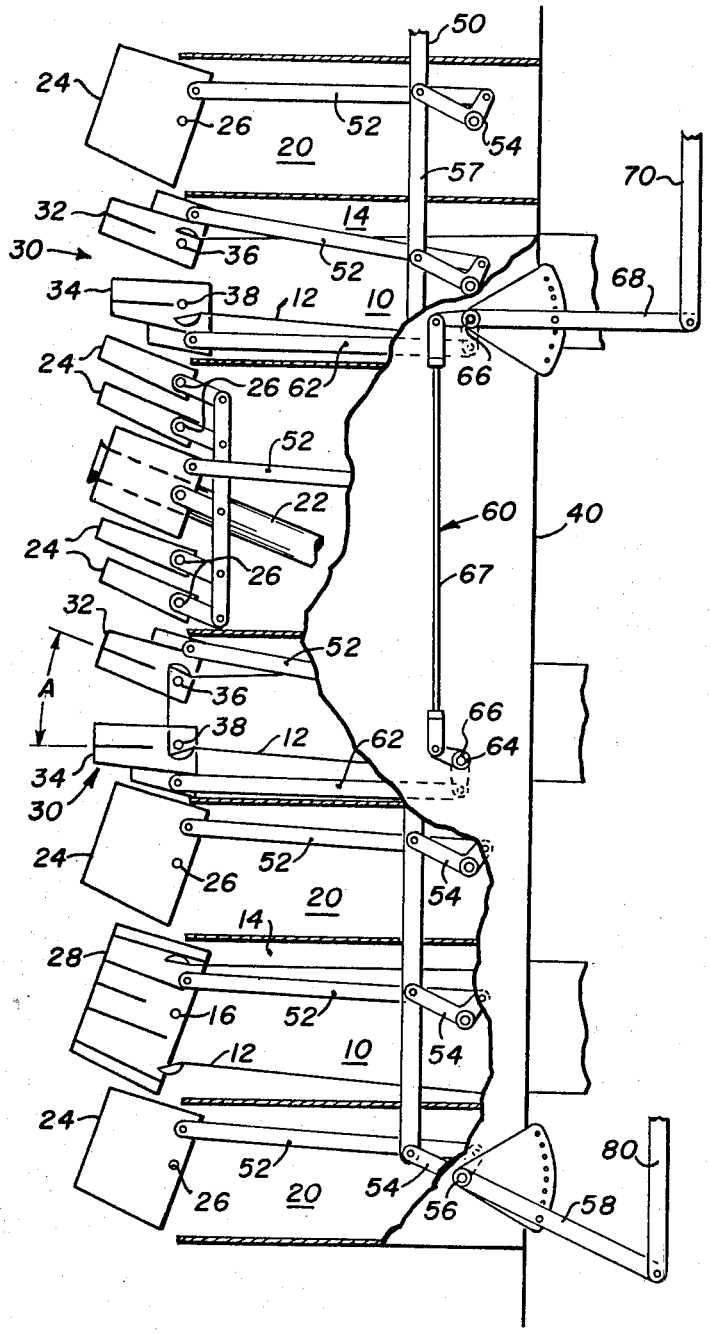
FIG. 4 is an elevational cross-sectional view of the windbox of FIG. 3 showing the lower nozzles of the split coal buckets of the two low load fuel-air admission assemblies tilted away from their corresponding upper nozzles as typifies operation at low load.

For example, if furnace load drops below approximately 30 percent of full load with all nozzles in the uptilt position as shown in FIG. 3, the low load tilt adjustment 70 would respond, either automatically as preferred or by operator command, by driving the low load tilt control lever 68 in a counterclockwise direction to decrease the tilt on the lower nozzles 34 of the split coal buckets 30 until the angle of separation A between the upper nozzles 32 and the lower nozzles 34 is in the range of 20° to 25° as illustrated in FIG. 4. By spreading the upper and lower nozzles apart, a stable ignition pocket is produced in the low pressure region between the fuel-air admission streams exiting therefrom.

If alternate means are utilized for steam temperature control at low loads, a main tilt adjustment means could also be divorced from responding to steam temperature. In such a case, it would be preferred to automatically activate the main tilt adjustment 80 to set the upper nozzles 32 of the split coal buckets 30 and the air nozzles 24 and the single coal buckets 28 operatively associated therewith to an upward tilt of 10° to 12°, and to activate the low load tilt adjustment 70 to set the lower nozzles 34 of the split coal bucket 30 to a downward tilt of 10° to 12°. This orientation is preferred because it minimizes the probability of the air stream exiting from the auxiliary air compartment immediately below a low load fuel-air admission assembly from interfering with the fuel-air admission stream exiting from the lower nozzle of the split coal bucket.

For instance, if the main tilt is set at 25° upward and the lower nozzle of the split coal bucket is orientated horizontally to establish the 25° separation desired between the upper and lower nozzles, the air stream exiting from the auxiliary air compartment nozzle immediately below the split coal bucket might prematurely intersect the fuel-air stream exiting from the lower nozzle of the split coal bucket and thereby adversely effect the formation of a stable ignition pocket.

Figure 1:
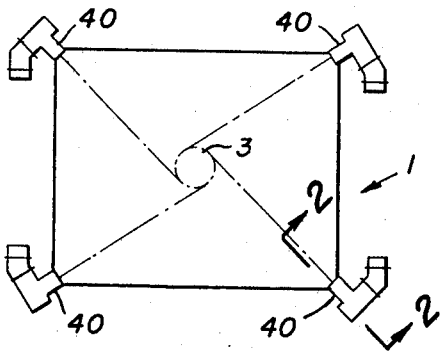
FIG. 1 is a diagrammatic plan view of a furnace employing the tangential firing method.
Figure 5:
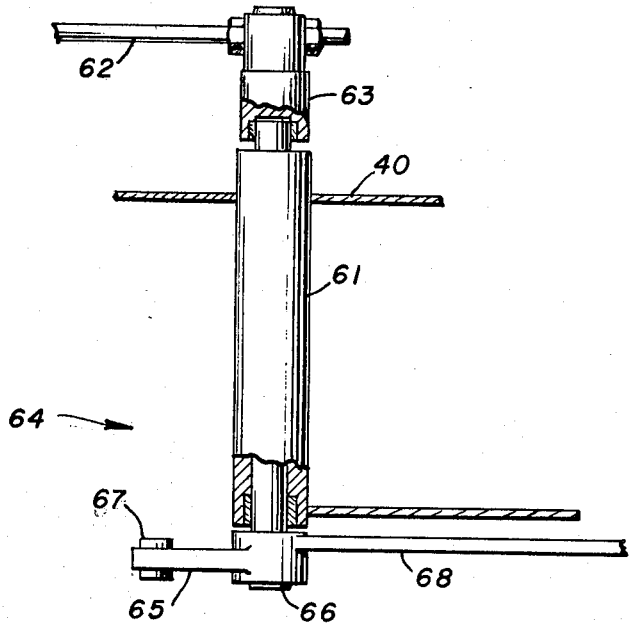
FIG. 5 is an enlarged plan view of the present invention taken along line 33 of FIG. 2.

A somewhat more detailed view of the bell crank 64 of the low load tilt nozzle apparatus of the present invention is shown in FIG. 5. Bell crank 64 comprises an axially elongated cylindrical shaft 61 which penetrates through the shell of and is originally mounted to the windbox 40, a cylindrical pivot shaft 66 freely rotatable within the shaft housing 61 having one end extending from the housing 61 within the windbox 40 and the other end extending from the housing 61 external to the windbox 40, a first lever arm 65 disposed externally to the windbox 40 and fixed to pivot shaft 66 so as to rotate therewith, and a second lever arm 63 disposed internally within the windbox 40 and also fixed to pivot shaft 66 so as to rotate therewith, the second lever arm 63 positioned on pivot shaft 66 so as to be orientated at a 90° angle with the first lever arm 65.

Low load tilt control lever 68 is originally mounted to the first lever arm 65 such that when control lever 68 is driven clockwise by low load tilt adjustment 70, the first lever arm 65 and the second lever arm 63 rotate clockwise with shaft 66 about an axis through shaft 66.

We claim:

1. In a pulverized coal-fired steam generator having a generally vertical furnace and a plurality of fuel-air admission assemblies arrayed in a vertical windbox in at least one wall of the furnace for introducing coal and air into the furnace, at least one of said fuel-air admission assemblies being a low load fuel-air admission assembly having a split coal bucket having vertically adjustable upper and lower coal nozzles, the remaining fuel-air admission assemblies having vertically adjustable single nozzle coal buckets; an apparatus for adjusting the vertical orientation of the upper and lower coal nozzles of said low load fuel-air admission assembly and the single nozzle coal buckets of the remaining fuel-air admission assemblies including:

a first tilt linkage mechanism interconnecting the upper coal nozzles of each low load fuel-air admission assembly disposed in said windbox and each single nozzle coal bucket disposed in said windbox so that same tilt in unison whenever said first tilt linkage mechanism is actuated, a second tilt linkage mechanism independent of said first tilt linkage mechanism interconnecting the lower coal nozzles of each low load fuel-air admission assembly disposed in said windbox so that same tilt in unison whenever said second tilt linkage mechanism is actuated, first tilt actuation means responsive to steam temperature variation for actuating said first tilt linkage mechanism so as to tilt the upper coal nozzle of said low load fuel-air admission assemblies upward in unison with the single nozzle coal buckets of the remaining fuel-air admission assemblies when said steam temperature drops below a preselected value and for tilting the upper coal nozzle of said low load fuel-air admission assemblies downward in unison with single nozzle coal buckets of the remaining fuel-air admission assemblies when the steam temperature rises above a preselected value, and second tilt actuation means responsive to steam temperature at higher loads and independent of steam temperature at low loads for actuating said second tilt linkage mechanism so as to tilt the lower coal nozzle of said low load fuel-air admission assemblies in unison with the upper coal nozzle of said low load fuel-air admission assemblies at higher loads and for tilting the lower coal nozzles of said low load fuel-air admission assemblies independently from and away from the upper coal nozzle of said low load fuel-air admission assemblies at low loads, said second tilt linkage mechanism comprising:

a. a plurality of horizontal shafts extending through the wall of the windbox, one shaft associated with each low load fuel-air admission assembly;

b. a plurality of bell cranks, one mounted upon and freely rotatable about each shaft, each bell crank having a first lever arm disposed externally of the windbox and a second lever arm disposed internally of the windbox;

c. a generally vertical extension bar disposed external of the windbox interconnecting the second lever arm of each of the bell cranks so as to operatively link each of the bell cranks together;

d. a plurality of generally horizontal link bars disposed internal of the windbox, each connecting the lower coal nozzle of a low load fuel-air admission assembly to the first lever arm of the bell crank associated therewith such that the vertical orientation of the lower coal nozzle changes as the bell crank associated therewith rotates; and e. means operatively associated with one of the plurality of bell cranks for rotating said bell crank about its shaft, said means responsive to said second tilt actuation means.

2. An apparatus, as recited in claim 1, wherein said second tilt actuation means responsive to steam temperature at loads above approximately 30 percent of the full load and independent of steam temperature at loads below approximately 30 percent of full load.

* * * * *